US006573035B1

(12) United States Patent
Haye et al.

(10) Patent No.: US 6,573,035 B1
(45) Date of Patent: Jun. 3, 2003

(54) STABLE MULTI-PART PHOTOGRAPHIC COLOR DEVELOPING COMPOSITION AND METHOD OF USE

(75) Inventors: Shirleyanne E. Haye, Rochester, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/077,537

(22) Filed: Feb. 15, 2002

(51) Int. Cl.[7] ..... G03C 7/413
(52) U.S. Cl. ..... 430/490
(58) Field of Search ..... 430/490

(56) References Cited

U.S. PATENT DOCUMENTS

| | | | | |
|---|---|---|---|---|
| 4,756,997 A | | 7/1988 | Marchesano | 430/478 |
| 4,876,174 A | | 10/1989 | Ishikawa et al. | 430/380 |
| 4,892,804 A | | 1/1990 | Vincent et al. | 430/380 |
| 5,273,865 A | * | 12/1993 | Loiacono et al. | 430/490 |
| 5,354,646 A | | 10/1994 | Koayashi et al. | 430/372 |
| 5,660,974 A | | 8/1997 | Marrese et al. | 430/490 |
| 6,136,518 A | | 10/2000 | Buongiorne et al. | 430/486 |

OTHER PUBLICATIONS

USSN 09/931,315 (D–82537) filed Aug. 16, 2001, titled "Three–Part Concentrated Photographic Color Developing Kit and Methods of Use" by Haye et al.
USSN 10/ (D–83754) filed on even date herewith, titled "Stable Photographic Color Developing Composition And Method Of Use" by Haye et al.

* cited by examiner

*Primary Examiner*—Hoa Van Le
(74) *Attorney, Agent, or Firm*—J. Lanny Tucker

(57) ABSTRACT

A multi-part (two-part or three-part) color developing kit includes aqueous solutions containing sulfite ions and a color developing agent. An α-ketocarboxylic acid or salt thereof, such as pyruvic acid or a salt thereof, is included in one or more of the aqueous solutions. These solutions can be combined, with or without dilution, to provide a color developing composition that can be used to process color photographic materials.

29 Claims, No Drawings

STABLE MULTI-PART PHOTOGRAPHIC COLOR DEVELOPING COMPOSITION AND METHOD OF USE

FIELD OF THE INVENTION

The present invention relates to multi-part photographic color developing kits that have improved stability, and to methods for their use in color photographic processing. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry. Other known color developing compositions are described in U.S. Pat. No. 4,876,174 (Ishikawa et al.), U.S. Pat. No. 5,354,646 (Kobayashi et al.), and U.S. Pat. No. 5,660,974 (Marrese et al.).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and additional water, a color developing composition can usually be obtained for use in the photographic processing machine.

It is generally known that the concentrations of various photochemicals and pH used in a photographic processing bath must be within certain narrow limits in order to provide optimal performance. A relatively small change in any of the component concentrations or pH can diminish desired photochemical activity, storage stability, solution homogeneity, or any combination of these. Thus, each "part" or solution used to make a working strength solution must be formulated to provide a desired balance of all desired properties.

There is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

Both single-part and multi-part solutions can be provided in concentrated form.

One concentrated form known in the art is a chemical paste or slurry, as described for example in EP-A-0 204,372 (Chemco) and EP-A-0 800,11 1 (Fuji Photo). These formulations have still other disadvantages, namely lack of homogeneity and slow dissolution rate of solid components.

Additional small volume, ready to use color developing compositions are described in U.S. Pat. No. 5,273,865 (Loiacono et al.). These compositions are said to be free of bromides, hydroxylamines and benzyl alcohol, to include a polyol compound having 4 to 8 hydroxy groups, and to be useful for rapid access processing of photographic elements having high silver bromide emulsions only.

A very useful single-part color developing composition that is homogeneous, concentrated, and stable is described and claimed in U.S. Pat. No. 6,077,651 (Darmon et al.). Such compositions are stable from the presence of the free base form of the color developing agent and a particular amount of water-soluble organic solvent.

Advantageous concentrated multi-part solutions for color development are described in U.S. Pat. No. 6,136,518 (Buongiorne et al.) and in copending and commonly assigned U.S. Ser. No. 09/931,315 (filed Aug. 16, 2001 by Haye and Huston).

Stability of the color developing agents in such compositions is generally achieved using sulfite ions or any of the many conventional organic antioxidants (or preservatives) that reduce aerial oxidation rates. For example, U.S. Pat. No. 4,892,804, U.S. Pat. No. 4,876,174, U.S. Pat. No. 5,354,646, and U.S. Pat. No. 5,660,974 (all noted above) describe hundreds of possible derivatives of hydroxylamines that can be used as antioxidants in color developing compositions.

However, there is a desire in the photoprocessing industry to find additional means of stabilizing multi-part compositions or kits used to formulate color developing compositions.

SUMMARY OF THE INVENTION

This invention addresses the problems noted above with a two-part color developing kit comprising:

(I) a first aqueous solution having a pH of from about 7 to about 13, and (II) a second aqueous solution having a pH of from about 1 to about 6 and comprising:

(a) at least 0.005 mol/l of a color developing agent, and (b) at least 0.001 mol/l of sulfite ions, further comprising at least 0.01 mol/l of α-ketocarboxylic acid or salt thereof in the first or second solutions, or both.

This two-part color developing kit can be used to prepare a color developing composition by:

(A) combining the first and second aqueous solutions (I) and (II) noted above in such a manner that the volume ratio of the first aqueous solution to the second aqueous solution is from about 2:1 to about 1:2.

This invention also provides a three-part color developing kit comprising:

(I) a first aqueous solution having a pH of from about 8 to about 12 and comprising:
(a) at least 0.005 mol/l of an organic antioxidant, (II) a second aqueous solution having a pH of from about 1 to about 3 and comprising:
(a) at least 0.005 mol/l of a color developing agent, and
(b) at least 0.001 mol/l of sulfite ions, and (III) a third aqueous solution having a pH of at least 7 and comprising:
(a) a buffering agent, and
(b) at least 0.001 mol/l of halide ions wherein at least one of the first, second, and third aqueous solutions further comprises at least 0.01 mol/l of an α-ketocarboxylic acid or a salt thereof.

This invention further provides a photographic processing chemical kit comprising:

a) the two- or three-part color developing kit described above, and b) one or more of the following compositions:
a photographic bleaching composition,
a photographic bleach-fixing composition,
a photographic fixing composition, and
a photographic stabilizing or rinsing composition.

A color developing composition can be obtained by mixing the following three aqueous solutions:

(I) a first aqueous solution having a pH of from about 8 to about 13 and comprising:
(a) at least 0.005 mol/l of an organic antioxidant, (II) a second aqueous solution having a pH of from about 1 to about 3 and comprising:
(a) at least 0.005 mol/l of a color developing agent, and
(b) at least 0.001 mol/l of sulfite ions, and (III) a third aqueous solution having a pH of at least 7 and comprising:
(a) a buffering agent, and
(b) at least 0.001 mol/l of halide ions wherein at least one of the first, second, and third aqueous solutions further comprises at least 0.01 mol/l of an α-ketocarboxylic acid or a salt thereof, (A) by combining the first, second, and third aqueous solutions in such a manner that the volume ratio of the first aqueous solution to the second aqueous solution is from about 1:1 to about 1:2, the volume ratio of the first aqueous solution to the third aqueous solution is from about 1:1 to about 1.5:1, and the volume ratio of the second aqueous solution to the third aqueous solution is from about 1:1 to about 3:1.

In addition, this method can further comprise:

(B) simultaneously or subsequently to step A, diluting the first, second, and third aqueous solutions with water in such a manner as to dilute the first aqueous solutions at least 10 times, to dilute the second aqueous solution at least 5 times, and to dilute the third aqueous solution at least 4 times.

A method of this invention for providing a color image comprises contacting an imagewise exposed color silver halide photographic material with a color developing composition prepared by mixing or combining the aqueous solutions of either the two- or three-part color developing kit as described above. The color developing step in a photographic processing method can be followed by desilvering the color developed color photographic silver halide element, as well as any other useful photoprocessing steps known in the art.

The multi-part color developing composition kit of this invention offers a number of advantages. The various aqueous solutions ("parts") can be safely handled and disposed of. The resulting working strength solution from mixing the parts can be readily prepared in a safe manner prior to or during use. The various solutions can be provided in a variety of packaged volumes for ease of transport, handling, and use, thereby reducing transportation and storage costs, particularly if the solutions are "concentrates."

One or more "parts" of the color developing kit of this invention are stabilized with the presence of an α-ketocarboxylic acid or a salt thereof. This compound acts to stabilize various components but particularly the color developing agent when the solutions are combined for use in photoprocessing.

DETAILED DESCRIPTION OF THE INVENTION

The present invention provides a multi-part color developing kit that can be used to provide color images in imagewise exposed color photographic silver halide materials. In this application, the terms "part" and "multi-part" are well understood in the photographic industry to refer to a single solution or multiple solutions, respectively. Generally, a two-part kit requires two individual aqueous solutions, and a three-part kit requires three individual aqueous solutions, to be mixed in a suitable fashion to provide the desired working strength photoprocessing color developing composition. Mixing of the individual aqueous solutions can occur prior to or during use in a processing machine.

The first aqueous solution can be merely water but in other embodiments, it generally contains one or more buffers (described below), and optionally one or more organic antioxidants as the only essential components. Such organic antioxidants include hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Mixtures of compounds from the same or different classes of organic antioxidants can also be used if desired.

Especially useful antioxidants are hydroxylamine derivatives as described for example, in U.S. Pat. No. 4,892,804 (noted above), U.S. Pat. No. 4,876,174 (noted above), U.S. Pat. No. 5,354,646 (noted above), U.S. Pat. No. 5,660,974 (noted above), U.S. Pat. No. 5,709,982 (Marrese et al.), and U.S. Pat. No. 5,646,327 (Bums et al.), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. The most preferred hydroxylamine derivatives comprise one or more sulfo, carboxy, or hydroxy solubilizing groups.

Some representative hydroxylamine derivative antioxidants include N,N-diethylhydroxylamine, N-isopropyl-N-etbylsulfonatohydroxylamine, and N,N-diethylsulfonatohydroxylamine.

Some optional components of the first aqueous solution include alkanolamines (such as triethanolamine and diethanolamine), optical brighteners, metal ion sequestering agents, surfactants, and fragrances.

The second aqueous solution generally includes two essential components: sulfite ions and one or more color developing agents Sulfite ions can be provided by sodium sulfite, potassium sulfite, sodium bisulfite, or potassium metabisulfite.

Color developing agents are well known in the art as compounds that, in oxidized form, will react with dye forming color couplers in the processed photographic materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921 A1 (published Mar. 10, 1993). It may be useful for the color developing agents to have one or more water-solubilizing groups as are known in the art. Further details of such materials are provided in *Research Disclosure*, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In some embodiments, the color developing agents can be used in "free base form" as described in U.S. Pat. No. 6,077,651 (noted above).

The second aqueous solution can also include various optional components such as lithium and magnesium ions provided as lithium and magnesium salts, and metal ion sequestering agents.

Where a third aqueous solution (or "part") is used, it contains one or more buffers and halide ions as the only essential components.

Buffering agents are generally present to provide or maintain desired alkaline pH of from about 7 to about 13, and preferably from about 8 to about 12, when the two or more solutions are mixed. These buffering agents are preferably soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

The third aqueous solution can include various halide ions such as bromide, iodide, and/or chloride ions. Preferably, it includes bromide and/or chloride ions.

Provided within one of the noted first, second, or third aqueous solutions, is one or more α-ketocarboxylic acids (or metal salts thereof) as stabilizing agents. These stabilizing agents can also be provided in two or three of the solutions.

Preferably, these stabilizing agents include an aliphatic group. Representative stabilizing agents include, but are not limited to, pyruvic acid, oxalacetic acid, glyoxylic acid, mesoxalic acid, 2-ketobutyric acid and 2-ketoglutaric acid. Pyruvic acid, glyoxylic, and their salts are preferred. Pyruvic acid and its salts are most preferred. Mixtures of these stabilizing agents can be used if desired. These stabilizing agents can be provided as ammonium, alkali metal or alkaline earth metal salts such as sodium salts. These compounds are commercially available from a number of chemical suppliers including Aldrich Chemical Company.

In addition to buffering agents, the pH of any of the solutions can also be raised or lowered to a desired value using one or more acids or bases. It may be particularly desirable to raise the pH by adding a base, such as a hydroxide (for example sodium hydroxide or potassium hydroxide).

Another optional but preferred component of one or more aqueous solutions of the color developing composition kit of this invention is a polycarboxylic acid (or salt thereof) or polyphosphonic acid (or salt thereof) as a calcium ion or other metal ion sequestering or chelating agent. Mixtures of these compounds can also be used. Preferably, these compounds are present in the second or third aqueous solutions. There are many such compounds known in the art including U.S. Pat. No. 4,546,068 (Kuse), U.S. Pat. No. 4,596,765 (Kurematsu et al.), U.S. Pat. No. 4,892,804 (noted above), U.S. Pat. No. 4,975,357 (Buongiorne et al.), U.S. Pat. No. 5,034,308 (Abe et al.), and *Research Disclosure* publications Item 20405 (April, 1981), Item 18837 (December, 1979), Item 18826 (December, 1979), and Item 13410 (December, 1975).

Phosphonic acid metal ion sequestering agents are well known in the art, and are described for example in U.S. Pat. No. 4,596,765 (noted above) and *Research Disclosure* publications Item 13410 (June, 1975), 18837 (December, 1979), and 20405 (April, 1981).

Useful metal ion sequestering agents are readily available from a number of commercial sources. Particularly useful phosphonic acids are the disphosphonic acids (and salts thereof) and polyaminopolyphosphonic acids (and salts thereof) described below. It is preferable to use one or more compounds of these classes in combination. Useful disphosphonic acids include hydroxyalkylidene disphosphonic acids, aminodiphosphonic acids, amino-N,N-dimethylenephosphonic acids, and N-acyl aminodisphosphonic acids.

Particularly useful polyphosphonic acids (and salts thereof) polyaminopolyphosphonic acid (or salt thereof) that has at least five phosphonic acid (or salt) groups. A mixture of such compounds can be used if desired. Suitable salts include ammonium and alkali metal ions salts.

Preferred compounds of this nature can be represented by the following Structure I:

I

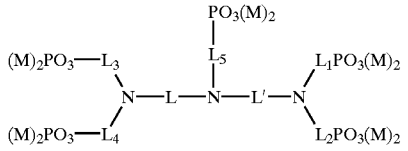

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

A particularly useful sequestering agent of this type is diethylenetriaminepentamethylenephosphosphonic acid or an alkali metal salt thereof (available as DEQUEST™ 2066 from Solutia Co.).

Still another optional but preferred sequestering agent is a diphosphonic acid (or salt thereof) that includes hydroxyalkylidene diphosphonic acids (or salts thereof). Mixtures of such compounds can be used if desired. Useful salts include the ammonium and alkali metal ion salts.

Preferred hydroxyalkylidene diphosphonic acids (or salts thereof) can be represented by the following Structure II:

II

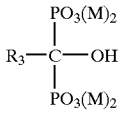

wherein $R_3$ is a substituted or unsubstituted alkyl group having 1 to 5 carbon atoms (methyl, methoxymethyl, ethyl, isopropyl, n-butyl, t-butyl and n-pentyl)and M is hydrogen or a monovalent cation (such as ammonium or alkali metal ions). Preferably, $R_3$ is methyl or ethyl, and most preferably, it is ethyl.

Representative sequestering agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST™ 2010, and its tetrasodium salt is available as DEQUEST™ 2016D, both from Solutia Co.

Another useful sequestering agent is morpholinomethanediphosphonic acid or a salt thereof that is available as BUDEX™ 5103 from Budenheim (Germany). This and similar cyclicaminodiphosphonic acids (and salts thereof) are described in U.S. Pat. No. 4,873,180 (Marchesano et al.).

It is also possible to include other metal ion sequestering agents (for example, for iron, copper or manganese ion sequestration) in one or more aqueous solutions.

One or more of the aqueous solutions can also include one or more of a variety of other addenda that are commonly used in photographic color developing compositions, including auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art. The amounts of such additives are well known in the art also.

Representative multi-part color developing kits of this invention are described below in the examples.

In some color developing kits of this invention, it is preferred that no lithium or magnesium ions are present in any of the aqueous solutions. Depending upon the concentrations of such ions in water used to make up processing solutions, or carried over from previous processing baths, the total concentration (that is, the sum) of these ions remains preferably very low, that is less than 0.0001 mol/l in the compositions, and preferably a total of less than 0.00001 mol/l.

The following TABLES I, II, and III list the general and preferred amounts of the essential and some optional components of the first, second, and third aqueous solutions used in the three-part color developing kits of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I

FIRST SOLUTION

| COMPONENT | CONCENTRATIONS |
|---|---|
| Organic antioxidant(s) | 0.005–2 mol/l (0.05–1.5 mol/l) |
| α-Ketocarboxylic acid (or salt) (if present) | 0.01–2.5 mol/l (0.02–2 mol/l) |
| pH | 8–12 (9–11) |

TABLE II

SECOND SOLUTION

| COMPONENT | CONCENTRATIONS |
|---|---|
| Color developing agent(s) | 0.005–1 mol/l (0.05–0.8 mol/l) |
| Sulfite ions | 0.001–0.5 mol/l (0.01–0.3 mol/l) |
| α-Ketocarboxylic acid (or salt) (if present) | 0.05–2.5 mol/l (0.02–2 mol/l) |
| pH | 1–3 (1.5–2.5) |

TABLE III

THIRD SOLUTION

| COMPONENT | CONCENTRATIONS |
|---|---|
| Buffer(s) | 0.5–7.5 mol/l (1.5–6 mol/l) |
| Halide ions | 0.001–1 mol/l (0.05–0.8 mol/l) |
| α-Ketocarboxylic acid (or salt) (if present) | 0.05–2.5 mol/l (0.02–2 mol/l) |
| pH | 7–14 (10–14) |

The following TABLES IV and V list the general and preferred amounts of the essential and some optional components of the first and second aqueous solutions used in the two-part color developing kits of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE IV

| FIRST SOLUTION | |
|---|---|
| COMPONENT | CONCENTRATIONS |
| Buffer(s) if present | 0.5–7.5 mol/l (1.5–6 mol/l) |
| α-Ketocarboxylic acid (or salt) (if present) | 0.01–2.5 mol/l (0.02–2 mol/l) |
| Organic antioxidant(s) (if present) | 0.005–2 mol/l (0.05–1.5 mol/l) |
| pH | 7–13 (9–12) |

TABLE V

| SECOND SOLUTION | |
|---|---|
| COMPONENT | CONCENTRATIONS |
| Color developing agent(s) | 0.005–1 mol/l (0.05–0.8 mol/l) |
| Sulfite ions | 0.001–0.5 mol/l (0.01–0.3 mol/l) |
| Organic antioxidant(s) (if present) | 0.005–2 mol/l (0.05–1.5 mol/l) |
| α-Ketocarboxylic acid (or salt) (if present) | 0.01–2.5 mol/l (0.02–2 mol/l) |
| pH | 1–6 (4–6) |

A particularly preferred three-part color developing kit of this invention comprises:

(I) a first concentrated aqueous solution that has a pH of from about 9 to about 11 and comprises:
  (a) from about 0.05 to about 1.5 mol/l of a hydroxylamine derivative antioxidant,
  (b) one or more of an alkanolamine or an optical brightener, and
  (c) from 0 to about 2 mol/l of pyruvic acid, glyoxylic acid, or a salt thereof, (II) a second concentrated aqueous solution that has a pH of from about 1.5 to about 2.5 and comprises:
  (a) from about 0.05 to about 0.8 of 4-(N-ethyl-N-2-methanesulfonylaminoethyl)-2-methylphenylenediamine sesquisulfate (KODAK Color Developing Agent CD-3),
  (b) from about 0.01 to about 0.3 mol/l of sulfite ions, and
  (c) from 0 to about 2 mol/l of pyruvic acid, glyoxylic acid, or a salt thereof, and (III) a third concentrated aqueous solution that has a pH of from about 10 to about 14 and comprises:
  (a) from about 0.05 to about 0.8 mol/l of bromide, chloride, or iodide ions, or any of these, and
  (b) from 0 to 2 mol/l of pyruvic acid, glyoxylic acid, or a salt thereof, provided that at least one of the first, second, and third concentrated solutions includes at least 0.02 mol/l of pyruvic acid, glyoxylic acid, or a salt thereof.

The multiple aqueous solutions of the color developing kit are mixed in a suitable fashion to form a working strength color developing composition either during or prior to its use. Thus, the aqueous solutions can be appropriately metered into a vessel to form the working strength composition, or they can be metered into the processing tank at a suitable rate during use (that is during photoprocessing). Each solution can be in "concentrated form" (that is, it may require some dilution for use) or at working strength.

In either case, the first and second solutions are mixed at a volume ratio of from about 1:1 to about 1:2. The first and third aqueous solutions are mixed at a volume ratio of from about 1:1 to about 1.5:1, and the second and third aqueous solutions are mixed at a volume ratio of from about 1:1 to about 3:1.

At the same time as the mixing, or subsequently thereto, the first, second, and third aqueous solutions can be diluted with water at least 10, 5, and 4 times, respectively. Thus, water can be added to the mixed solutions, or water can be metered separately into the mixture when the concentrated aqueous solutions are mixed. Alternatively, water can be metered as a fourth stream into a processing vessel when the three aqueous solutions are separately metered into the vessel. The final pH of the working strength composition is generally from about 9.5 to about 11.

The working strength color developing compositions obtained from mixing or combining the aqueous solutions of the kits of this invention have utility to provide color development in an imagewise exposed color photographic silver halide element comprising a support and one or more color silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

If the present invention is used to process color photographic papers, those papers generally include high chloride (greater than 70 mole % chloride and preferably greater than 90 mole % chloride, based on total silver) emulsions. Such color photographic papers can have any useful amount of silver coated in the one or more emulsions layers, and in some embodiments, low silver (that is, less than about 0.8 g silver/$m^2$) elements can be processed with the present invention.

Representative commercial color papers that are useful in the practice of this invention include, but are not limited to, KODAK EKTACOLOR EDGE 5, 7, 8, and 9 Color Papers (Eastman Kodak Company), KODAK EKTACOLOR ROYAL VII and VIII Color Papers (Eastman Kodak Company), KODAK PROFESSIONAL PORTRA IV Color Papers (Eastman Kodak Company), KODAK PROFESSIONAL SUPRA III and IV Color Papers (Eastman Kodak Company), KODAK PROFESSIONAL ULTRA III Color Papers (Eastman Kodak Company), KODAK PROFESSIONAL METALLIC Color Papers (Eastman Kodak Company), KODAK DURALIFE Color Paper (Eastman Kodak Company), KODAK PROFESSIONAL PORTRA Black and White Papers (Eastman Kodak Company), FUJI SUPER Color Papers (Fuji Photo Co., FA5, FA7 and FA9), FUJI CRYSTAL ARCHIVE and Type C and D Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK PROFESSIONAL DURATRANS display materials, KODAK DURACLEAR, KODAK EKTAMAX RAL and KODAK PROFESSIONAL DURAFLEX print materials, and KODAK PROFESSIONAL Digital III Color Paper Type can also be processed using the present invention. The compositions and constructions of such commercial color photographic elements could be readily determined by one skilled in the art.

The present invention can also be used to process color negative films that generally have a transparent polymeric film support and various emulsion and interlayers thereon to provide three color records. Such elements are also very well known in the art as described for example in U.S. Pat. No. 6,013,424 (Schmittou et al.) and *Research Disclosure* noted above and include those having a magnetic recording layer or strip on the support opposite the silver halide emulsion layers.

Representative color negative films that can be processed using the present invention include, but are not limited to, KODAK ROYAL GOLD Color Films, KODAK MAX Color Films, KODAK ADVANTiX® Color Films, KODAK VERICOLOR III Color Films, KONICA VX400 Color Film, KONICA Super SR400 Color Film, FUJI SUPER Color Films, LUCKY Color Films, and other commercial products currently on the market. Color negative films used in "one-time-use" cameras can also be processed using the present invention.

Color development of an imagewise exposed photographic silver halide element is carried out by contacting the element with a working strength color developing composition prepared according to this invention under suitable time and temperature conditions and in suitable processing equipment, to produce the desired developed color images. Additional processing steps can then be carried out using conventional procedures, including but not limited to, one or more development stop, desilvering steps (such as bleaching, fixing, or bleach/fixing), washing (or rinsing), stabilizing and drying steps, in any particular desired order as would be known in the art. Useful processing steps, conditions and materials useful therein are well known for the various processing protocols including the conventional Process C-41 processing of color negative films, Process RA-4 for processing color papers and Process E-6 for processing color reversal films (see for example, *Research Disclosure* publication 38957 noted above).

More details of the element structure and components, and suitable methods of processing various types of elements are described in *Research Disclosure* publication 38957 (noted above). Included within such teachings is the use of various classes of cyan, yellow and magenta color couplers that can be used with the present invention (including pyrazolone and pyrazolotriazole type magenta dye forming couplers.

In a preferred embodiment, the working strength color developing composition prepared according to this invention is brought into contact with the imagewise exposed color photographic silver halide material in any suitable fashion in a processing tank. Alternatively, the processing composition can be sprayed onto the material using suitable application devices. Without removing the material from the color developing composition, it is then subjected to desilvering, that is removal of silver. This can be done with one or more steps, including a bleaching step following by a fixing step, a fixing step followed by a bleaching step and/or a fixing step, a single bleach/fixing step, or any combination thereof. It is essential in this embodiment that the desilvering step(s) be carried out without removing the color photographic silver halide material from the working strength color developing composition. In other words, the desilvering composition(s) are added to the color developing composition after a sufficient time for color development, or sprayed onto the material without removing the color developing composition.

Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al.) and U.S. Pat. No. 5,753,423 (Buongiome et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003 (Ueda et al.), and ethylenediamine monosuccinic acid and similar compounds as described in U.S. Pat. No. 5,691,120 (Wilson et al.).

Useful fixing agents are also well known in the art and include various thiosulfates and thiocyanates or mixtures thereof as described for example in U.S. Pat. No. 6,013,424 (Schmittou et al.).

Rinsing and/or stabilizing steps can be carried out after desilvering if desired using various rinsing or stabilizing compositions that may include one or more anionic or nonionic surfactants. Representative compositions for this purpose are, for example, described in U.S. Pat. No. 5,534,396 (McGuckin et al.), U.S. Pat. No. 5,578,432 (McGuckin et al.), U.S. Pat. No. 5,645,980 (McGuckin et al.), U.S. Pat. No. 5,667,948 (McGuckin et al.), and U.S. Pat. No. 5,716,765 (McGuckin et al.).

The processing time and temperature used for each processing step of the present invention can be those conventionally used in the art. For example, color development and desilvering can be generally carried out independently at temperatures of from about 20 to about 60° C. The overall color development time can be up to 40 minutes, and preferably from about 75 to about 450 seconds. More preferably, the color development time is from about 30 to about 90 seconds when processing color negative films. Even shorter color development times may be used for processing color photographic papers.

Desilvering can be carried out for from about 30 to about 480 seconds using one or more bleaching, fixing, or bleach/fixing steps. Preferably, a fixing step is carried out for from about 20 to about 240 seconds followed by a bleaching step for from about 20 to about 240 seconds.

Processing according to the present invention can be carried out using any suitable processing machine including those having deep tanks for holding processing solutions.

Alternatively, it can be carried out using what is known in the art as "low volume thin tank" processing systems, or LVTT, which have either a rack and tank or automatic tray design. These processors are sometimes known as "minilab" processing machines. Such processing methods and equipment are described, for example, in U.S. Pat. No. 5,436,118 (Carli et al.) and publications noted therein. Some useful minilab processing machines are commercially available as Noritsu 2211SM Printer/Paper Processor, Noritsu 2102SM Printer/Paper Processor and Noritsu 2301 SM Printer/Paper Processor.

The color developing kit of this invention can be included in larger photoprocessing kits that include one or more other photographic processing compositions (dry or liquid) including, but not limited to, a photographic bleaching composition, a photographic bleach/fixing composition, a photographic fixing composition, and a photographic dye stabilizing or rinsing composition. Such additional compositions can be formulated in concentrated or working strength solutions, or provided in dry form (for example, as a powder or tablet). Other processing compositions that can be included in such kits for either black and white or color photographic processing are reversal compositions, conditioning compositions, prebleach compositions, acidic stop compositions, and others readily apparent to one skilled in the photographic art. The processing kits can also include various processing equipment, metering devices, processing instructions, silver recovery devices and other conventional materials as would be readily apparent to one skilled in the art.

The various concentrated aqueous solutions of the color developing kit of this invention (and any other desired photoprocessing compositions) can be provided in various packaged forms and/or containers. They can be provided in bottles, drums, flexible containers (for example, what are known as "cubitainers" or "bag-in-a-box"), vials, packets or any other suitable container. The volumes for each aqueous solution can be the same or different. The containers can also be packaged together in a suitable manner for ease of shipping, use and disposal.

In one embodiment, the first, second and third aqueous solutions described above for the kit of this invention are provided in individual flexible (or collapsible) containers having some type of dispensing means (or conduit). Such embodiments are described in detail in U.S. Pat. No. 5,577,614 (Palmeroni, Jr. et al.), incorporated herein by reference. In such embodiments, the flexible containers (or various sizes) are packaged together in a package that is designed for both shipping and solution dispensing, such as in a minilab processing machine. For example, the dispensing conduits of the flexible containers are designed for mating with valves and other connectors in the minilab processing machines.

The following examples are provided to illustrate the practice of this invention and are not intended to limit it in any way. Unless otherwise indicated, percentages are by weight.

EXAMPLE 1

Use of a Pyruvate in Part A of Kit

A three-part color developing kit of this invention was formulated with the following components in the three separate parts (solutions):

| PART | COMPONENT | CONCENTRATION (g/l) Comparison | Invention |
|---|---|---|---|
| A (pH 10.65) | Triethanolamine (85%) | 134.81 | 134.81 |
| | N,N-diethylhydroxylamine (85%) | 115.96 | 115.96 |
| | Phorwite REU optical brightener | 23.84 | 23.84 |
| | Versa-TL 74 (30%) sulfonated polystyrene | 3.7 | 3.7 |
| | Sodium pyruvate | 0 | 107.5 |
| B (pH 1.9) | Kodak Color Developing Agent CD-3 | 295.65 | 295.65 |
| | Lithium sulfate | 86.96 | 86.96 |
| | Magnesium sulfate.$7H_2O$ | 9.0 | 9.0 |
| | Potassium sulfite (45%) | 36.3 | 36.3 |
| C (pH 13.8) | Potassium hydroxide (49%) | 63.02 | 63.02 |
| | Potassium chloride | 59.97 | 59.97 |
| | Potassium bromide | 0.375 | 0.375 |
| | DEQUEST ™ 2010 sequestering agent (60%) | 12.89 | 12.89 |
| | Potassium carbonate (47%) | 789.1 | 789.1 |

Each of solutions A, B, and C was diluted to 1 liter with water. Lithium and magnesium sulfates can be removed if DEQUEST™ 2066 sequestering agent is used instead of DEQUEST™ 2010 sequestering agent in Part C. Approximately 46.5 ml of Part A, 23.0 ml of Part B, and 66.7 ml of Part C were combined and diluted to make 1 liter of a working strength color developing solution.

EXAMPLE 2

Use of Pyruvic Acid in Part B of Kit

In this example of the invention, the pyruvate stabilizing compound was placed in the Part B solution. The three parts (solutions) had the following components:

| PART | COMPONENT | CONCENTRATION (g/l) Comparison | Invention |
|---|---|---|---|
| A (pH 10.65) | Triethanolamine (85%) | 134.81 | 134.81 |
| | N,N-diethylhydroxylamine (85%) | 115.96 | 115.96 |
| | Phorwite REU optical brightener (180) | 23.84 | 23.84 |
| | Versa-TL 74 (30%) sulfonated polystyrene | 3.7 | 3.7 |
| B pH 1.9 | Kodak Color Developing Agent CD-3 | 295.65 | 295.65 |
| | Lithium sulfate | 86.96 | 86.96 |
| | Magnesium sulfate.$7H_2O$ | 9.0 | 9.0 |
| | Potassium sulfite (45%) | 36.3 | 36.3 |
| | Pyruvic acid | 0 | 174.03 |
| C pH 13.8 | Potassium hydroxide (49%) | 63.02 | 63.02 |
| | Potassium chloride | 59.97 | 59.97 |
| | Potassium bromide | 0.375 | 0.375 |
| | DEQUEST ™ 2010 sequestering agent (60%) | 12.89 | 12.89 |
| | Potassium carbonate (47%) | 789.1 | 789.1 |

In this example, pyruvic acid is used instead of sodium pyruvate. Lithium and magnesium sulfate are optional in Part B. Approximately 46.5 ml of Part A, 23.0 ml of Part B, and 66.7 ml of Part C were combined and diluted to make 1 liter of a working strength color developing solution.

EXAMPLE 3

Use of a Pyruvate in Part C of Kit

In this embodiment of the invention, the pyruvate stabilizing compound was placed in the Part C solution. The three parts (solutions) had the following components:

| PART | COMPONENT | CONCENTRATION (g/l) Comparison | Invention |
|---|---|---|---|
| A | Triethanolamine (85%) | 134.81 | 134.81 |
| (pH 10.65) | N,N-diethylhydroxylamine (85%) | 115.96 | 115.96 |
| | Phorwite REU (180) optical brightener | 23.84 | 23.84 |
| | Versa-TL 74 (30%) sulfonated polystyrene | 3.7 | 3.7 |
| B | Kodak Color Developing Agent CD-3 | 295.65 | 295.65 |
| (pH 1.9) | Lithium sulfate | 86.96 | 86.96 |
| | Magnesium sulfate.7H20 | 9.0 | 9.0 |
| | Potassium sulfite (45%) | 36.3 | 36.3 |
| C | Potassium hydroxide (49%) | 63.02 | 63.02 |
| (pH 13.8) | Potassium chloride | 59.97 | 59.97 |
| | Potassium bromide | 0.375 | 0.375 |
| | DEQUEST ™ 2010 sequestering agent (60%) | 12.89 | 12.89 |
| | Sodium pyruvate | 0 | 74.96 |
| | Potassium carbonate (47%) | 789.1 | 789.1 |

Lithium and magnesium sulfate in Part B are optional. Approximately 46.5 ml of Part A, 23.0 ml of Part B, and 66.7 ml of Part C were combined and diluted to make 1 liter of a working strength color developing solution.

EXAMPLE 4

Color Paper Processing

Samples of KODAK Edge 8 Color Paper were given a step wedge test object exposure at 1/10 sec with HA-50, NP-11 filters, and 0.3 Inconel on a conventional 1B sensitometer. The samples were then processed using a color developing composition provided by combining the three solutions of the multi-part color developing kit of Example 1. Processing was carried out in a deep tank processor using conventional EKTACOLOR Process RA-4 conditions and steps as follows:

| | | |
|---|---|---|
| Color Development | 38° C. | 45 seconds |
| Bleach/fixing | 35° C. | 45 seconds |
| Washing/Stabilizing | 35° C. | 90 seconds |

Bleach/fixing was carried out using commercially available KODAK EKTACOLOR Prime Bleach-Fix and the washing step was carried out using KODAK EKTACOLOR Prime Stabilizer. After processing, the color paper samples were allowed to dry in the air at ambient temperature. The desired colored images were obtained in all of the samples.

EXAMPLE 5

Two-Part Color Developing Kit

A two-part color developer kit of the present invention was prepared with two following solutions:

| PART | COMPONENTS | CONCENTRATION (g/l) |
|---|---|---|
| A | Potassium hydroxide (49%) | 40 |
| (pH 11.4) | Triethanolamine (85%) | 58.4 |
| | DEQUEST ™ 2066 (25%) sequestering agent | 41.6 |
| | Versa-TL 74 (30%) sulfonated polystyrene | 1.36 |
| | Potassium chloride | 32 |
| | Potassium bromide | 0.24 |
| | Sodium pyruvate | 40 |
| | Potassium carbonate | 420.8 |
| B | Potassium sulfite (45%) | 6.72 |
| (pH 5.7) | N,N-diethylhydroxylamine (85%) | 43.2 |
| | KODAK Color Developing Agent CD-3 | 54.4 |
| | Phorwite REU (180) optical brightener | 8.8 |

In this example approximately 125 ml of Part A and 125 ml Part B were combined and diluted to make 1 liter of working strength developing composition. The final composition pH was 10.8.

The resulting color developing composition was used for color development of imagewise exposed samples of commercially available Kodak Ektacolor Edge VIII Color Paper samples in a deep-tank conventional RA-4 process as described in Example 4. The desired color images were obtained.

EXAMPLE 6

Alternative Two-Part Color Developing Kit

The two-part color developing kit of Example 5 was changed to put the sodium pyruvate (same amount) in Part B. This color developing kit was also used to provide color images in color paper samples.

The invention has been described in detail with particular reference to preferred embodiments thereof, but it will be understood that variations and modifications can be effected within the spirit and scope of the invention.

We claim:

1. A two-part color developing kit comprising:

(I) a first aqueous solution having a pH of from about 7 to about 13, and (II) a second aqueous solution having a pH of from about 1 to about 6 and comprising:

(a) at least 0.005 mol/l of a color developing agent, and (b) at least 0.001 mol/l of sulfite ions, further comprising at least 0.01 mol/l of a α-ketocarboxylic acid or salt thereof in said first or second solutions, or both.

2. The color developing kit of claim 1 wherein said first aqueous solution comprises a buffer and has a pH of from about 9 to about 12, and said second aqueous solution has a pH of from about 4 to about 6.

3. The color developing kit of claim 1 wherein said color developing agent is present in said second aqueous solution in an amount of from about 0.05 to about 0.8 mol/l, and an organic antioxidant is present in said first or second aqueous solution in an amount of from about 0.005 to about 2 mol/l.

4. The color developing kit of claim 3 wherein said antioxidant is hydroxylamine or a hydroxylamine derivative comprising one or more sulfo, carboxy, or hydroxy groups.

5. The color developing kit of claim 1 further comprising a buffer in at least one of said aqueous solutions.

6. The color developing kit of claim 1 wherein said α-ketocarboxylic acid or salt thereof is present in one of said aqueous solutions in an amount of from about 0.01 to about 2.5 mol/l.

7. The color developing kit of claim 1 wherein said α-ketocarboxylic acid or salt thereof is pyruvic acid, oxalacetic acid, glyoxylic acid, mesoxalic acid, 2-ketobutyric acid, 2-ketoglutaric acid, or an ammonium, alkali metal, or alkaline earth metal salt thereof.

8. A three-part color developing kit comprising:

(I) a first aqueous solution having a pH of from about 8 to about 12 and comprising:
  (a) at least 0.005 mol/l of an organic antioxidant,
  (II) a second aqueous solution having a pH of from about 1 to about 3 and comprising:
  (a) at least 0.005 mol/l of a color developing agent, and
  (b) at least 0.001 mol/l of sulfite ions, and (III) a third aqueous solution having a pH of at least 7 and comprising:
  (a) a buffering agent, and
  (b) at least 0.01 mol/l of halide ions wherein at least one of said first, second, and third aqueous solutions further comprises at least 0.01 mol/l of an α-ketocarboxylic acid or a salt thereof.

9. The color developing kit of claim 8 wherein at least one of said first, second, and third aqueous solutions includes a polycarboxylic acid or salt thereof or a polyphosphonic acid or salt thereof as a sequestering agent.

10. The color developing kit of claim 8 wherein said α-ketocarboxylic acid or salt thereof is pyruvic acid, oxalacetic acid, glyoxylic acid, mesoxalic acid, 2-ketobutyric acid, 2-ketoglutaric acid, or an ammonium, alkali metal, or alkaline earth metal salt thereof, that is present in an amount of from about 0.01 to about 2.5 mol/l.

11. The color developing kit of claim 10 wherein said α-ketocarboxylic acid or salt thereof is glyoxylic acid, pyruvic acid, or a salt thereof that is present in an amount of from about 0.1 to 2 mol/l.

12. The color developing kit of claim 8 wherein said α-ketocarboxylic acid or salt thereof is present in any of said solutions in an amount of from about 0.1 to 2 mol/l.

13. The color developing kit of claim 8 wherein said first aqueous solution has a pH of from about 9 to about 11, said second aqueous solution has a pH of from about 1.5 to about 2.5, said third aqueous solution has a pH of from about 10 to about 14, said organic antioxidant is present in said first aqueous solution in an amount of from about 0.05 to about 1.5 mol/l, said color developing agent is present in said second aqueous solution in an amount of from about 0.05 to about 0.8 mol/l, sulfite ions are present in said second aqueous solution in an amount of from about 0.01 to about 0.3 mol/l, said buffer is a carbonate buffer that is present in said third aqueous solution in an amount of from about 1.5 to about 6 mol/l, and said α-ketocarboxylic acid or salt thereof is present in at least one of said aqueous solutions in an amount of from about 0.1 to about 2 mol/l.

14. The color developing kit of claim 8 wherein said third aqueous solution comprises both chloride and bromide ions.

15. The color developing kit of claim 8 wherein all three aqueous solutions are free of lithium and magnesium ions.

16. A photographic processing chemical kit comprising:

a) a two-part color developing kit comprising:
  (I) a first aqueous solution having a pH of from about 7 to about 13, and
  (II) a second aqueous solution having a pH of from about 1 to about 6 and comprising:
    (a) at least 0.005 mol/l of a color developing agent, and
    (b) at least 0.001 mol/l of sulfite ions,
  further comprising at least 0.01 mol/l of a α-ketocarboxylic acid or salt thereof in said first or second solutions, or both, and b) one or more of the following compositions:
  a photographic bleaching composition,
  a photographic bleach-fixing composition,
  a photographic fixing composition, and
  a photographic stabilizing or rinsing composition.

17. A photographic processing chemical kit comprising:

a) a three-part color developing kit comprising:
  (I) a first aqueous solution having a pH of from about 8 to about 12 and comprising:
    (a) at least 0.005 mol/l of an organic antioxidant,
  (II) a second aqueous solution having a pH of from about 1 to about 3 and comprising:
    (a) at least 0.005 mol/l of a color developing agent, and
    (b) at least 0.001 mol/l of sulfite ions, and
  (III) a third aqueous solution having a pH of at least 7 and comprising:
    (a) a buffering agent, and
    (b) at least 0.01 mol/l of halide ions
  wherein at least one of said first, second, and third aqueous solutions further comprises at least 0.01 mol/l of an α-ketocarboxylic acid or a salt thereof, and b) one or more of the following compositions:
  a photographic bleaching composition,
  a photographic bleach-fixing composition,
  a photographic fixing composition, and
  a photographic stabilizing or rinsing composition.

18. A color developing composition obtained by mixing the three aqueous solutions of a three-part color developing kit comprising:

(I) a first aqueous solution having a pH of from about 8 to about 12 and comprising:
  (a) at least 0.005 mol/l of an organic antioxidant,
(II) a second aqueous solution having a pH of from about 1 to about 3 and comprising:
  (a) at least 0.005 mol/l of a color developing agent, and
  (b) at least 0.001 mol/l of sulfite ions, and
(III) a third aqueous solution having a pH of at least 7 and comprising:
  (a) a buffering agent, and
  (b) at least 0.01 mol/l of halide ions wherein at least one of said first, second, and third aqueous solutions further comprises at least 0.01 mol/l of an α-ketocarboxylic acid or a salt thereof, and by combining said first, second, and third aqueous solutions in such a manner that the volume ratio of said first aqueous solution to said second aqueous solution is from about 1:1 to about 1:2, the volume ratio of said first aqueous solution to said third aqueous solution is from about 1:1 to about 1.5:1, and the volume ratio of said second aqueous solution to said third aqueous solution is from about 1:1 to about 3:1.

19. A color developing composition obtained by mixing the two aqueous solutions of a two-part color developing kit comprising:

(I) a first aqueous solution having a pH of from about 7 to about 13, and (II) a second aqueous solution having a pH of from about 1 to about 6 and comprising:

(a) at least 0.005 mol/l of a color developing agent, and (b) at least 0.001 mol/l of sulfite ions, further comprising at least 0.01 mol/l of a α-ketocarboxylic acid or salt thereof in said first or second solutions, or both, by combining said first and second aqueous solutions in such a manner that the volume ratio of said first aqueous solution to said second aqueous solution is from about 2:1 to about 1:2.

20. A method of providing a color image comprising contacting an imagewise exposed color silver halide photographic material with a color developing composition provided by mixing the two aqueous solutions of a two-part color developing kit comprising:

(I) a first aqueous solution having a pH of from about 7 to about 13, and (II) a second aqueous solution having a pH of from about 1 to about 6 and comprising:

(a) at least 0.005 mol/l of a color developing agent, and (b) at least 0.001 mol/l of sulfite ions, further comprising at least 0.01 mol/l of a α-ketocarboxylic acid or salt thereof in said first or second solutions, or both.

21. The method of claim 20 further comprising desilvering said color silver halide photographic material after said contacting step.

22. The method of claim 21 wherein said color photographic silver halide material is carried out by contacting it with one or more desilvering processing compositions without removing said material from said color developing composition.

23. The method of claim 20 wherein said color silver halide photographic material is a color photographic paper.

24. A method of providing a color image comprising contacting an imagewise exposed color silver halide photographic material with the color developing composition provided by mixing the three aqueous solutions of a three-part color developing kit comprising:

(I) a first aqueous solution having a pH of from about 8 to about 12 and comprising:

(a) at least 0.005 mol/l of an organic antioxidant, (II) a second aqueous solution having a pH of from about 1 to about 3 and comprising:

(a) at least 0.005 mol/l of a color developing agent, and (b) at least 0.001 mol/l of sulfite ions, and (III) a third aqueous solution having a pH of at least 7 and comprising:

(a) a buffering agent, and (b) at least 0.01 mol/l of halide ions wherein at least one of said first, second, and third aqueous solutions further comprises at least 0.01 mol/l of an α-ketocarboxylic acid or a salt thereof.

25. The method of claim 24 comprising:

simultaneously or subsequently to said mixing of said three aqueous solutions, diluting said first, second, and third aqueous solutions with water in such a manner as to dilute said first aqueous solution at least 10 times, to dilute said second aqueous solution at least 5 times, and to dilute said third aqueous solution at least 4 times.

26. The method of claim 24 further comprising desilvering said color silver halide photographic material after said contacting step.

27. The method of claim 24 wherein said color photographic silver halide material is carried out by contacting it with one or more desilvering processing compositions without removing said material from said color developing composition.

28. The method of claim 24 wherein said color silver halide photographic material is a color photographic paper.

29. A three-part color developing kit comprising:

(I) a first concentrated aqueous solution that has a pH of from about 9 to about 11 and comprises:

(a) from about 0.05 to about 1.5 mol/l of a hydroxylamine derivative antioxidant, (b) one or more of an alkanolamine or an optical brightener, and (c) from 0 to about 2 mol/l of pyruvic acid, glyoxylic acid, or a salt thereof, (II) a second concentrated aqueous solution that has a pH of from about 1.5 to about 2.5 and comprises:

(a) from about 0.05 to about 0.8 of 4-(N-ethyl-N-2-methanesulfonylaminoethyl)-2-methylphenylenediamine sesquisulfate (KODAK Color Developing Agent CD-3), (b) from about 0.01 to about 0.3 mol/l of sulfite ions, and (c) from 0 to about 2 mol/l of pyruvic acid, glyoxylic acid, or a salt thereof, and (III) a third concentrated aqueous solution that has a pH of from about 10 to about 14 and comprises:

(a) from about 0.05 to about 0.8 mol/l of bromide, chloride, or iodide ions, or any of these, and (b) from 0 to 2 mol/l of pyruvic acid, glyoxylic acid, or a salt thereof, provided that at least one of the first, second, and third concentrated aqueous solutions includes at least 0.02 mol/l of pyruvic acid, glyoxylic acid, or a salt thereof.

* * * * *